US009232300B2

(12) United States Patent
Miki et al.

(10) Patent No.: US 9,232,300 B2
(45) Date of Patent: Jan. 5, 2016

(54) BASS REFLEX PORT AND TUBULAR BODY

(71) Applicant: Yamaha Corporation, Hamamatsu-shi, Shizuoka-ken (JP)

(72) Inventors: Akira Miki, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/209,656

(22) Filed: Mar. 13, 2014

(65) Prior Publication Data

US 2014/0262598 A1 Sep. 18, 2014

(30) Foreign Application Priority Data

Mar. 15, 2013 (JP) ..... 2013-054157

(51) Int. Cl.
*H04R 1/22* (2006.01)
*H04R 1/28* (2006.01)
*H04R 1/20* (2006.01)

(52) U.S. Cl.
CPC ..... *H04R 1/2815* (2013.01)

(58) Field of Classification Search
USPC ..... 181/156, 199, 148; 381/349, 345
See application file for complete search history.

(56) References Cited

U.S. PATENT DOCUMENTS 811,877 A * 2/1906 Senne ..... 181/192
896,672 A * 8/1908 Terhune ..... 181/192
915,013 A * 3/1909 Beecroft ..... 181/192
960,834 A * 6/1910 Cunnius ..... 181/192
1,600,024 A * 9/1926 Walker ..... 181/192
5,109,422 A * 4/1992 Furukawa ..... 381/96
D372,874 S * 8/1996 Wong ..... D10/6
5,623,132 A * 4/1997 Gahm ..... 181/156
5,714,721 A * 2/1998 Gawronski et al. ..... 181/156

(Continued)

FOREIGN PATENT DOCUMENTS

JP 55-010217 A 1/1980
JP 58-173988 A 11/1983

(Continued)

OTHER PUBLICATIONS

Anonymous. (2013). "Monitor Audio," Design for Sound, HiVe II Port Technology, located at: http://www.monitoraudio.co.uk/biography/technology/hive-ii/, last visited on Apr. 28, 14, three pages.

(Continued)

*Primary Examiner* — Edgardo San Martin
(74) *Attorney, Agent, or Firm* — Morrison & Foerster LLP

(57) ABSTRACT

A bass reflex port having a tubular shape for air flows, wherein an angle of a first inner radial line with respect to a reference plane including a center axis of the bass reflex port differs from an angle of a second inner radial line with respect to the reference plane, the first line being orthogonal to the center axis and passing a first characteristic point on an inner circumference of the bass reflex port in a first transverse cross section perpendicular to the center axis, the second line being orthogonal to the center axis and passing a second characteristic point corresponding to the first characteristic point and located on the inner circumference in a second transverse cross section perpendicular to the center axis, the first transverse cross section and the second transverse cross section differing form each other in position in a direction of extension of the center axis.

16 Claims, 9 Drawing Sheets

(56) References Cited

U.S. PATENT DOCUMENTS

| | | | | |
|---|---|---|---|---|
| 5,892,183 | A * | 4/1999 | Roozen et al. | 181/156 |
| 6,334,505 | B1 * | 1/2002 | Li | 181/192 |
| 7,146,021 | B2 * | 12/2006 | Danovi | 381/432 |
| 7,162,049 | B2 * | 1/2007 | Polk, Jr. | 381/345 |
| 7,252,175 | B2 * | 8/2007 | Suzuki | 181/156 |
| 7,711,134 | B2 * | 5/2010 | Stead et al. | 381/345 |
| 8,094,853 | B2 * | 1/2012 | Seki | 381/337 |
| 8,744,108 | B2 * | 6/2014 | Trainer | 381/345 |
| 2005/0189164 | A1 * | 9/2005 | Chang | 181/152 |
| 2009/0260915 | A1 | 10/2009 | Arai | |
| 2014/0262597 | A1 * | 9/2014 | Miki et al. | 181/156 |

FOREIGN PATENT DOCUMENTS

| | | | | |
|---|---|---|---|---|
| JP | 59-111385 | A | 7/1984 | |
| JP | H02-044495 | A | 3/1990 | |
| JP | 05268686 | A * | 10/1993 | H04R 1/02 |
| JP | 2000-165974 | A | 6/2000 | |
| JP | 2006-340206 | A | 12/2006 | |
| JP | 2008-048176 | A | 2/2008 | |
| JP | 2012-161109 | A | 8/2012 | |

OTHER PUBLICATIONS

Notification of Reason for Refusal mailed Feb. 13, 2015, for JP Patent Application No. 2013-054157, with English translation, four pages.

Decision of Refusal mailed Jun. 16, 2015, for Japanese Patent Application No. JP 2013-054157, with English translation, three pages.

* cited by examiner

EXISTING PORT I (ELLIPTICITY LARGE) : EXTRANEOUS NOISE SMALL

EXISTING PORT II (ELLIPTICITY SMALL) : EXTRANEOUS NOISE LARGE

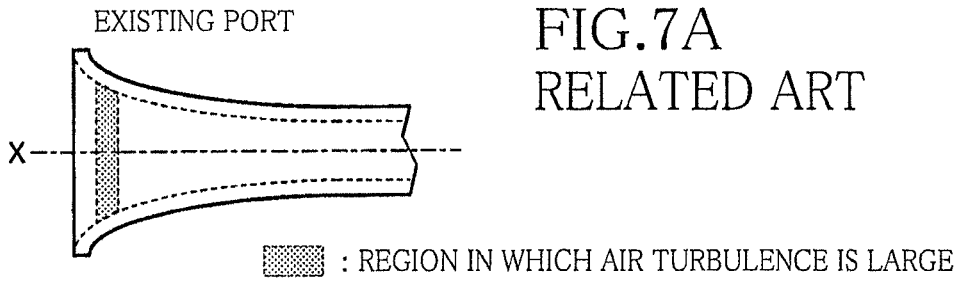
FIG.7A
RELATED ART
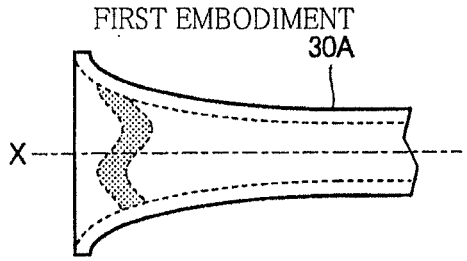
FIG.7B
FIG.8
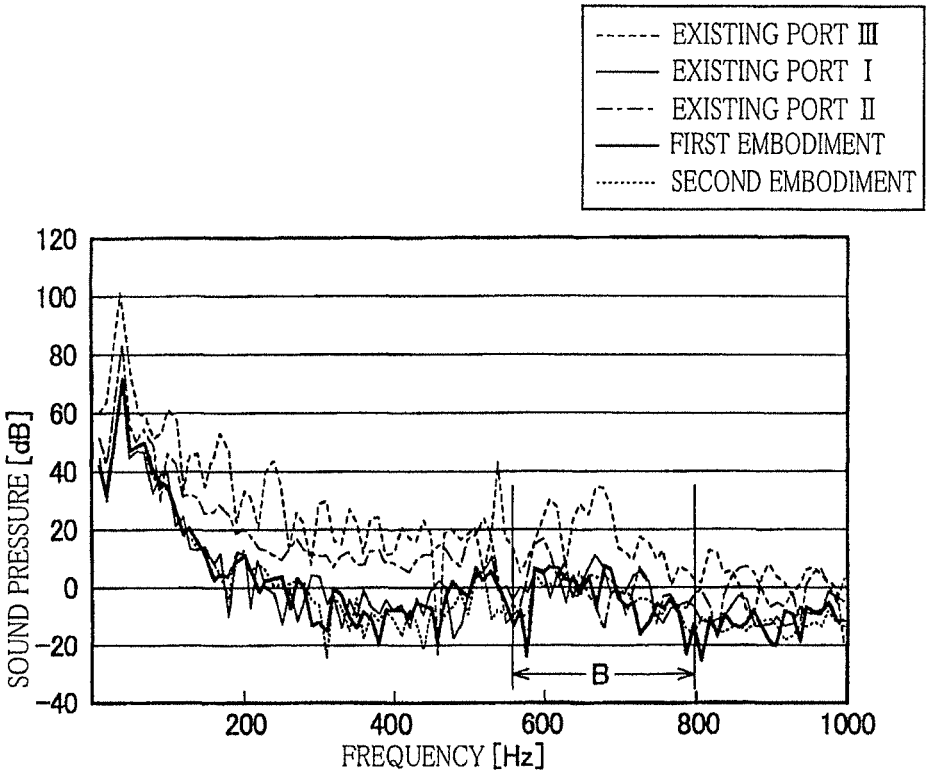

BASS REFLEX PORT AND TUBULAR BODY

CROSS REFERENCE TO RELATED APPLICATION

The present application claims priority from Japanese Patent Application No. 2013-054157, which was filed on Mar. 15, 2013, the disclosure of which is herein incorporated by reference in its entirety.

BACKGROUND OF THE INVENTION

1. Field of the Invention

The present invention relates to a tubular body through which air flows and more particularly to a structure of a tubular body suitable for a bass reflex port of a speaker device.

2. Description of Related Art

There is conventionally proposed a bass reflex type speaker device configured to enhance sound volume in the bass range utilizing sound emitted rearward from a speaker unit. In the bass reflex type speaker device, a bass reflex port is disposed for communication between an inside and an outside of a housing (enclosure) of the speaker device. For instance, the following Patent Literature 1 discloses a speaker device having a bass reflex port whose end portions near opposite ends thereof have a flare shape in which an inner diameter increases toward a distal end of each end portion, for the purpose of reducing extraneous or abnormal noise.

Patent Literature 1: JP-A-2008-048176

SUMMARY OF THE INVENTION

It is, however, actually difficult to sufficiently reduce extraneous noise emitted from the speaker device via the bass reflex port merely by forming the end portions of the bass reflex port near its opposite ends into a simple flare shape. Where the volume of reproduced sound is large, for instance, there is a possibility that extraneous noise originating from the bass reflex port is perceived by a listener. The present invention has been developed in view of the situations. It is therefore an object of the invention to reduce extraneous noise emitted from a tubular body such as a bass reflex port.

The object indicated above may be achieved according to one aspect of the invention, which provides a bass reflex port which has a tubular shape and through which air flows, wherein an angle of a first inner radial line with respect to a reference plane that includes a center axis of the bass reflex port differs from an angle of a second inner radial line with respect to the reference plane, the first inner radial line being orthogonal to the center axis and passing a first characteristic point located on an inner circumference of the bass reflex port in a first transverse cross section perpendicular to the center axis, the second inner radial line being orthogonal to the center axis and passing a second characteristic point corresponding to the first characteristic point and located on the inner circumference in a second transverse cross section perpendicular to the center axis, the first transverse cross section and the second transverse cross section differing form each other in position in a direction of extension of the center axis.

The object indicated above may be achieved according to another aspect of the invention, which provides a bass reflex port which has a tubular shape and through which air flows, wherein a locus that connects characteristic points each located on an inner circumference of the bass reflex port in a corresponding one of a plurality of transverse cross sections is helical, the transverse cross sections being perpendicular to a center axis of the bass reflex port and differing from each other in position in a direction of extension of the center axis.

The object indicated above may be achieved according to still another aspect of the invention, which provides a tubular body through which air passes, wherein an angle of a first inner radial line with respect to a reference plane that includes a center axis of the tubular body differs from an angle of a second inner radial line with respect to the reference plane, the first inner radial line being orthogonal to the center axis and passing a first characteristic point located on an inner circumference of the tubular body in a first transverse cross section perpendicular to the center axis, the second inner redial line being orthogonal to the center axis and passing a second characteristic point corresponding to the first characteristic point and located on the inner circumference in a second transverse cross section perpendicular to the center axis, the first transverse cross section and the second transverse cross section differing form each other in position in a direction of extension of the center axis.

The object indicated above may be achieved according to yet another aspect of the invention, which provides a bass reflex port which has a tubular shape and through which air flows, wherein a trough portion and a crest portion are repeatedly formed on an inner circumferential surface of the bass reflex port along a circumferential direction of the bass reflex port, a distance between the trough portion and the center axis in a direction perpendicular to the center axis being larger than a distance between the crest portion and the center axis in the direction perpendicular to the center axis.

FORMS OF THE INVENTION

There will be described various forms of the invention.

A bass reflex port (30B) which has a tubular shape and through which air flows, wherein an angle of a first inner radial line with respect to a reference plane that includes a center axis of the bass reflex port differs from an angle of a second inner radial line with respect to the reference plane, the first inner radial line being orthogonal to the center axis and passing a first characteristic point located on an inner circumference of the bass reflex port in a first transverse cross section perpendicular to the center axis, the second inner radial line being orthogonal to the center axis and passing a second characteristic point corresponding to the first characteristic point and located on the inner circumference in a second transverse cross section perpendicular to the center axis, the first transverse cross section and the second transverse cross section differing form each other in position in a direction of extension of the center axis.

In the bass reflex port constructed as described above, the angle of the inner radial line that passes the characteristic point on the inner circumference and that is orthogonal to the center axis differs between the first transverse cross section and the second transverse cross section. Accordingly, symmetry of vortex rings generated in the bass reflex port is lowered, as compared with that in an arrangement in which the angle of the inner radial line is kept constant irrespective of the position of the transverse cross section in the direction of extension of the center axis. It is therefore possible to reduce extraneous noise emitted from the bass reflex port.

A typical example of the characteristic point on the inner circumference is an extreme point at which an inner radius has an extreme value (a maximum point of the inner radius or a minimum point of the inner radius, for instance. The characteristic point may be an angular portion or an inflection point on the inner circumference. Further, the first characteristic point located on the inner circumference in the first transverse cross section and the second characteristic point located on the inner circumference in the second transverse cross section correspond to each other. This means that a positional relation of the first characteristic point on the inner circumference in the first transverse cross section with respect to a shape defined by the inner circumference in the first transverse cross section is similar to a positional relation of the second characteristic point on the inner circumference in the second transverse cross section with respect to a shape defined by the inner circumference in the second transverse cross section.

In the bass reflex port constructed as described above, an angle of an inner radial line with respect to the reference plane may continuously change with respect to a displacement, in the direction of extension of the center axis, of a transverse cross section perpendicular to the center axis, the inner radial line being orthogonal to the center axis and passing a characteristic point as each of the first characteristic point and the second characteristic point located on the inner circumference in the transverse cross section.

According to the bass reflex port constructed as described above, the angle of the inner radial line continuously changes with respect to the displacement of the transverse cross section. Accordingly, it is possible to reduce extraneous noise emitted from the bass reflex port and to enhance an aesthetic design of the bass reflex port as compared with an arrangement in which the angle of the inner radial line discontinuously changes. The angle of the inner radial line need not change over an entire length of the bass reflex port. For instance, the angle of the inner radial line may continuously change only in a specific section of the bass reflex port. It is particularly preferable that the inner radial line continuously rotate in one direction with respect to the displacement of the transverse cross section in the direction of extension of the center axis. In other words, the bass reflex port of the present invention may be expressed in such a way that a locus that connects characteristic points each located on an inner circumference of the bass reflex port in a corresponding one of a plurality of transverse cross sections is helical, the transverse cross sections being perpendicular to a center axis of the bass reflex port and differing from each other in position in a direction of extension of the center axis.

In the bass reflex port constructed as described above, a rotation angle of the inner radial line with respect to the displacement of the transverse cross section in the direction of extension of the center axis by a unit amount may differ depending upon a position of the transverse cross section in the direction of extension of the center axis.

For instance, the rotation angle of the inner radial line with respect to the displacement of the transverse cross section by a unit amount is larger on a distal end side of the bass reflex port than an intermediate side thereof. According to the thus constructed bass reflex port, it is possible to reduce extraneous noise emitted from the bass reflex port and to enhance an aesthetic design of the bass reflex port.

Preferably, a cross-sectional area (e.g., an area of an inner circumferential region Q) of the bass reflex port increases toward its distal end. In other words, the bass reflex port has a flare shape, for instance. The arrangement ensures an intensified effect of suppressing extraneous noise, as compared with a bass reflex port having a constant cross-sectional area at each position in the direction of extension of the center axis.

In the bass reflex port constructed as described above, a first locus and a second locus differ from each other in shape, the first locus connecting characteristic points each located on the inner circumference in a corresponding one of a plurality of transverse cross sections perpendicular to the center axis, the second locus connecting characteristic points each of which is located on the inner circumference in a corresponding one of the transverse cross sections and which differ from the characteristic points of the first locus.

According to the bass reflex port constructed as described above, the first locus connecting the first characteristic points and the second locus connecting the second characteristic points differ from each other in shape, thereby ensuring a particularly remarkable effect of reducing extraneous noise emitted from the bass reflex port. For instance, where each of the characteristic points that constitute the first locus is a maximum point PA, each of the characteristic points that constitute the second locus is a minimum point PB.

Preferably, the inner radius in the transverse cross section perpendicular to the center axis continuously changes along the circumferential direction of the center axis. For instance, an inner circumferential region enclosed by an inner circumferential surface of the bass reflex port in the transverse cross section perpendicular to the center axis may have a noncircular shape having rotational symmetry.

According to the bass reflex port constructed as described above, it is possible to distribute a region in which large air turbulence occurs in the bass reflex port, over a wide range in the direction of extension of the center axis, as compared with an arrangement in which the inner circumferential region of the bass reflex port has a perfect circular shape. Therefore, the effect of reducing extraneous noise emitted from the bass reflex port is particularly remarkable.

In the bass reflex port constructed as described above, an order of the rotational symmetry of the inner circumferential region may be an odd number.

In the bass reflex port constructed as described above, an order of the rotational symmetry of the inner circumferential region may be 3 or 5.

The bass reflex port constructed as described above is applicable to a speaker device. In this instance, the speaker device has a housing, a speaker unit fixed to the housing, and the above-indicated bass reflex port configured to permit communication between an inside and outside of the housing. In the thus constructed speaker device, it is possible to reduce extraneous noise emitted from the bass reflex port.

The present invention may be embodied as a tubular body having a structure similar to that of the above-indicated bass reflex port, as described below.

A tubular body (30B) through which air passes, wherein an angle of a first inner radial line with respect to a reference plane that includes a center axis of the tubular body differs from an angle of a second inner radial line with respect to the reference plane, the first inner radial line being orthogonal to the center axis and passing a first characteristic point located on an inner circumference of the tubular body in a first transverse cross section perpendicular to the center axis, the second inner redial line being orthogonal to the center axis and passing a second characteristic point corresponding to the first characteristic point and located on the inner circumference in a second transverse cross section perpendicular to the center axis, the first transverse cross section and the second transverse cross section differing form each other in position in a direction of extension of the center axis.

It is noted that the tubular body is used for arbitrary purposes.

A bass reflex port (30B) which has a tubular shape and through which air flows, wherein a trough portion and a crest portion are repeatedly formed on an inner circumferential surface of the bass reflex port along a circumferential direction of the bass reflex port, a distance between the trough portion and the center axis in a direction perpendicular to the center axis being larger than a distance between the crest portion and the center axis in the direction perpendicular to the center axis.

In the bass reflex port constructed as described above, an inner circumferential region enclosed by the inner circumferential surface of the bass reflex port in a transverse cross section perpendicular to the center axis may have a noncircular shape having rotational symmetry.

In the bass reflex port constructed as described above, an order of the rotational symmetry of the inner circumferential region may be an odd number.

In the bass reflex port constructed as described above, an order of the rotational symmetry of the inner circumferential region may be 3 or 5.

The bass reflex port constructed as described above may comprise an intermediate portion (32) and two end portions (342, 344) located on one and the other of opposite sides of the intermediate portion in a direction of extension of the center axis, wherein the crest portion and the trough portion may be formed in each of the two end portions and are not formed in the intermediate portion.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which:

FIGS. 7A and 7B are views for explaining a principle of reduction of extraneous noise in the first embodiment;

FIG. 8 shows frequency characteristics of reproduced sound by a plurality of sorts of bass reflex port;

DETAILED DESCRIPTION OF THE EMBODIMENTS

First Embodiment

Figure 1:
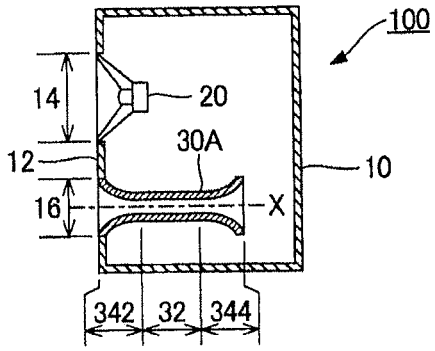
FIG. 1 is a cross-sectional view showing a speaker device according to a first embodiment of the present invention.

FIG. 1 is a cross-sectional view of a speaker device 100 according to a first embodiment of the present invention. As shown in FIG. 1, the speaker device 100 of the first embodiment is an acoustic device having a housing (enclosure) 10, a speaker unit 20, and a bass reflex port 30A and is configured to emit sound in accordance with acoustic signals supplied from an external device (not shown).

The housing 10 is a hollow structure (typically, a rectangular parallelepiped) constituted by a plurality of boards. A front-side one of the boards of the housing 10, i.e., a board 12, is formed with an opening portion 14 and an opening portion 16 each having a substantially circular shape. The speaker unit 20 is fixed in the opening portion 14. That is, the board 12 of the housing 10 functions as a baffle board. The speaker unit 20 is a sound emission body configured to emit sound in accordance with acoustic signals supplied from an external device (e.g., a signal processor such as an amplifier), by vibrating a vibration plate according to the acoustic signals. While a pitch (level) and a bandwidth of a reproduction band of the speaker unit 20 are not specific ones, the present invention is particularly preferable in a configuration that utilizes the speaker unit 20 (e.g., subwoofer) whose reproduction band is the bass range.

The bass reflex port (duct) 30A is a generally cylindrical tubular body disposed in the housing 10 for permitting communication between an inside and an outside of the housing 10. The bass reflex port 30A is configured to intensify and emit an acoustic component in the bass range among sound emitted from the speaker unit 20 toward the rear of the housing 10 by resonance (Helmholtz resonance). In other words, the housing 10 and the bass reflex port 30A constitute a Helmholtz resonator having a resonance frequency in the neighborhood of the lowest frequency of sound emitted frontward from the speaker unit 20.

Figure 2:
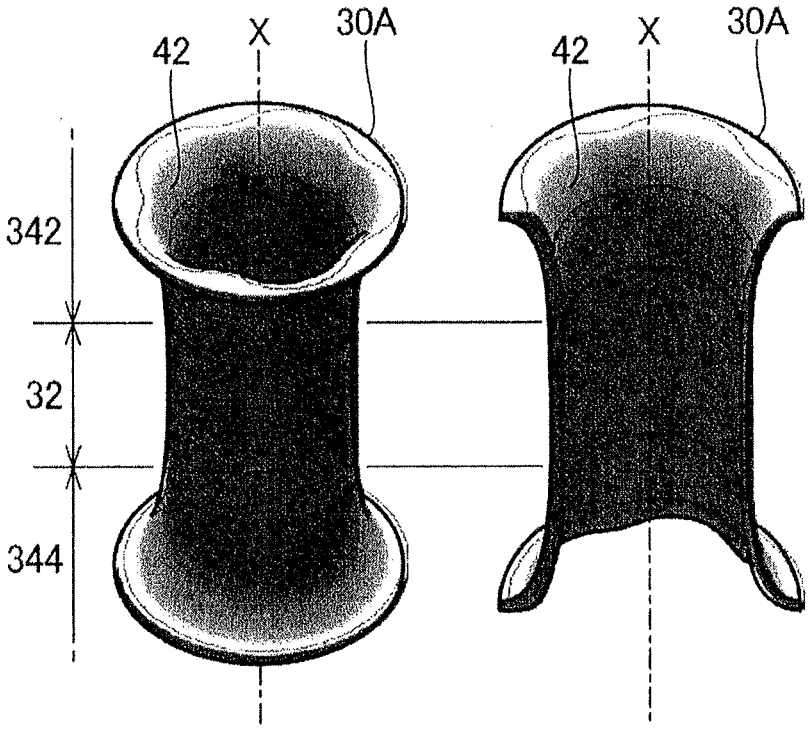
FIG. 2 is a perspective view and a cut view of the bass reflex port.

FIG. 2 is a perspective view and a cut view of the bass reflex port 30A. The cut view of FIG. 2 shows a state in which the bass reflex port 30A is cut on a plane that includes a center axis (tube axis) X of the bass reflex port 30A (hereinafter referred to as "vertical cross section" where appropriate). As shown in FIGS. 1 and 2, the bass reflex port 30A is sectioned into three portions along the center axis X, i.e., an intermediate portion 32, an end portion 342, and an end portion 344. The end portion 342 is located on one of opposite sides of the intermediate portion 32 (i.e., a front-side portion of the speaker device 100) while the end portion 344 is located on the other of the opposite sides of the intermediate portion 32 (i.e., a rear-side portion of the speaker device 100). As shown in FIG. 1, one end of the end portion 342 that is remote from the intermediate portion 32 (hereinafter referred to as "distal portion") is connected to an inner periphery of the opening portion 16 formed in the front-side board 12 of the housing 10, so that an inner circumferential surface (inner wall surface) 42 of the end portion 342 is continuous to the front surface of the board 12. On the other hand, one end (distal portion) of the end portion 344 that is remote from the intermediate portion 32 is located in the inside of the housing 10. In other words, the bass reflex port 30A protrudes rearward from the board 12 such that the center axis X is substantially orthogonal to the board 12. Here, the bass reflex port 30A is sectioned into the intermediate portion 32, the end portion 342, and the end portion 344 for the sake of convenience focusing on the structure of the bass reflex port 30A. Actually, the bass reflex port 30A is formed as an integral member by a production technique such as injection molding. It is noted, however, that the intermediate portion 32, the end portion 342, and the end portion 344 may be separately produced and then connected to each other. In the first embodiment, the end portion 342 and the end portion 344 are common in shape. Accordingly, in the following description, the end portion 342 and the end portion 344 are collectively referred to as an end portion 34 where appropriate, and individual explanation thereabout will be omitted. It is, however, possible to permit the end portion 342 and the end portion 344 to have mutually different shapes.

Figure 3:
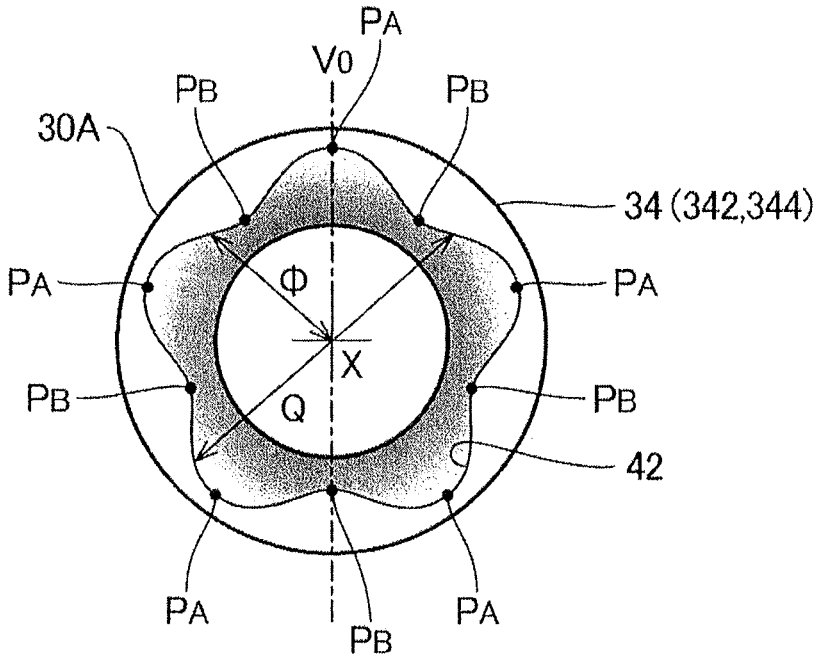
FIG. 3 is a front view of the bass reflex port.

FIG. 3 is a front view of the bass reflex port 30A when the distal portion of the end portion 34 is viewed from a direction of extension of the center axis X (hereinafter referred to as "extension direction of the center axis X" where appropriate), namely, a longitudinal direction of the bass reflex port 30A. As apparent from FIGS. 2 and 3, the intermediate portion 32 is a part of a straight tube in which a cross section perpendicular to the center axis X (hereinafter referred to as "transverse cross section" where appropriate) has a circular (annular) shape and in which an inside diameter and an outside diameter are maintained substantially constant at each position along the center axis X. On the other hand, the end portion 34 (342, 344) has a flare shape in which an area of a region Q enclosed by the inner circumferential surface 42 in the transverse cross section perpendicular to the center axis X continuously increases from another end of the end portion 34 that is near to the intermediate portion 32 (hereinafter referred to as "proximal portion") toward the distal portion. The region Q is hereinafter referred to as "inner circumferential region Q" where appropriate. The inner circumferential region Q corresponds to a cross section of an air flow passage in the bass reflex port 30A, namely, a cross section of an inside of the tube.

As shown in FIGS. 2 and 3, the inner circumferential region Q of the end portion 34 has a noncircular shape having rotational symmetry (N-fold symmetry) about the center axis X (N: natural number of not smaller than 2). The inner circumferential region Q has a shape similar to that of funnel-form corolla (petals of a convolvulus or the like). In the first embodiment, the inner circumferential region Q of the end portion 34 is constituted by a closed curve and has five-fold rotational symmetry (N=5). As is understood from FIGS. 2 and 3, from the distal portion of the end portion 34 toward the proximal portion thereof, the shape of the inner circumferential region Q gradually becomes close to a circle from the noncircular shape having five-fold rotational symmetry and becomes a circle at the proximal portion, so as to be continuous to the inner circumferential region Q of the intermediate portion 32 having a circular shape. That is, the shapes of the inner circumferential regions Q in the respective transverse cross sections in the extension direction of the center axis X correspond to each other.

As shown in FIG. 3, where a distance between: the center axis X; and an arbitrary point on a line of intersection of the transverse cross section and the inner circumferential surface 42 (i.e., a profile line of the inner circumferential region Q) is defined as an inner radius Φ of the end portion 34, it may be expressed that the inner circumferential region Q of the end portion 34 has a shape in which the inner radius Φ changes in a circumferential direction about the center axis X. More specifically, the inner radius Φ increases and decreases periodically and continuously at a unit (period) of 72° (360°/N) around the center axis X. Accordingly, there exist, on the profile line of the inner circumferential region Q, five (N) maximum points PA at each of which the inner radius Φ is maximum and five (N) minimum points PB at each of which the inner radius Φ is minimum, and the maximum point PA and the minimum point PB are alternate with each other every 36° (360°/2N) in the circumferential direction about the center axis X. As is understood from FIG. 3, each maximum point PA corresponds to the bottom of a trough portion of the inner circumferential surface 42 while each minimum point PB corresponds to the apex of a crest portion of the inner circumferential surface 42. Therefore, the profile line of the inner circumferential region Q may be referred to as a closed curve in which five crest portions and five trough portions are alternately arranged in the circumferential direction. As is understood from the explanation above, the inner circumferential region Q of the first embodiment has a shape in which a curvature is repeatedly increased and decreased in the circumferential direction about the center axis X. More specifically, the curvature of the profile line of the inner circumferential region Q repeatedly changes from one of a positive number and a negative number to the other of the positive number and the negative number along the circumferential direction. That is, in the inner circumferential region Q, there are alternately repeated, along the circumferential direction, a range in which the center of curvature is located inside the inner circumferential region Q and a range in which the center of curvature is located outside the inner circumferential region Q.

Figure 4:
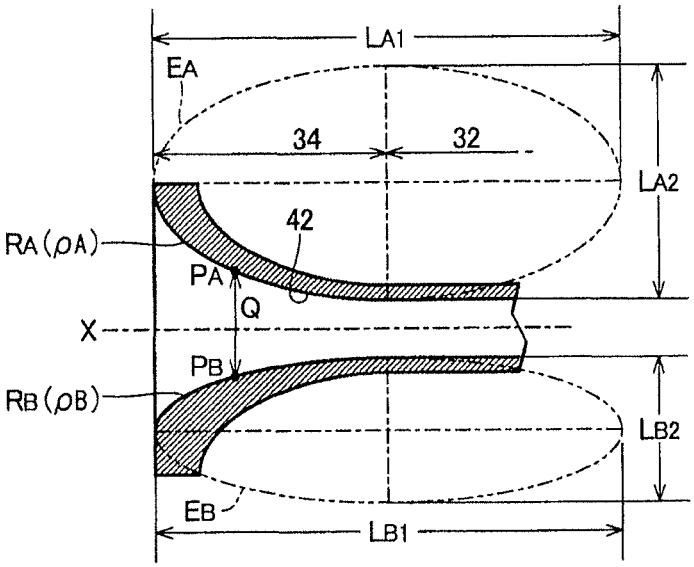
FIG. 4 is a vertical cross-sectional view of the bass reflex port.

FIG. 4 is a cross-sectional view of the end portion 34 in a vertical cross section V0 in FIG. 3. The vertical cross section V0 passes both of the maximum points PA and the minimum points PB. Accordingly, there exist, in the vertical cross section V0, a locus RA that connects a plurality of maximum points PA each located in the inner circumferential region Q of a corresponding one of a plurality of transverse cross sections that are arranged in the extension direction of the center axis X and a locus RB that connects a plurality of minimum points PB each located in the inner circumferential region Q of a corresponding one of the plurality of transverse cross sections. The locus RA corresponds to a line of intersection of the vertical cross section V0 and the inner circumferential surface 42, and the locus RB corresponds to a line of intersection of the vertical cross section V0 and the inner circumferential surface 42. Each of the locus RA and the locus RB is a curve in which a distance between: the locus RA or the locus RB; and the center axis X, i.e., the inner radius Φ, continuously increases from the proximal portion of the end portion 34 toward the distal portion thereof.

As mentioned above, the inner circumferential region Q of the end portion 34 has the noncircular shape in which the inner radius Φ changes in the circumferential direction about the center axis X. Accordingly, the locus RA and the locus RB differ from each other in shape. For instance, where the shape (the flare shape) of the inner circumferential surface 42 of the end portion 34 is defined such that each of the locus RA and the locus RB becomes an arc of an ellipse, as shown in FIG. 4, the locus RA and the locus RB differ from each other in ellipticity of the ellipse, i.e., a ratio of a minor axis with respect to a major axis of an ellipse. More specifically, the locus RA is an arc of an ellipse EA having a major axis LA1 and a minor axis LA2 while the locus RB is an arc of an ellipse EB having a major axis LB1 and a minor axis LB2. The minor axis LA2 of the ellipse EA that defines the locus RA is greater than the minor axis LB2 of the ellipse EB that defines the locus RB (LA2>LB2), and the major axis LA1 of the ellipse EA that defines the locus RA is equal to the major axis LB1 of the ellipse EB that defines the locus RB (LA1=LB1). Therefore, the ellipticity (LA2/LA1) of the ellipse EA of the locus RA is greater than the ellipticity (LB2/LB1) of the ellipse EB of the locus RB. That is, the curvature of the locus RA (i.e., an average value of the curvature over the entire length of the locus RA) is greater than the curvature of the locus RB. It may be expressed that the entire length of the locus RA is greater than the entire length of the locus RB. As is understood from the above explanation, it may be expressed that the inner circumferential surface 42 of the end portion 34 in the first embodiment has a shape in which the shape of the locus R (RA, RB) repeatedly changes in the circumferential direction about the center axis X, the locus R (RA, RB) connecting characteristic points (the maximum points PA or the minimum points PB) each on the profile line that defines the inner circumferential region Q of a corresponding one of the plurality of transverse cross sections.

Figure 5:
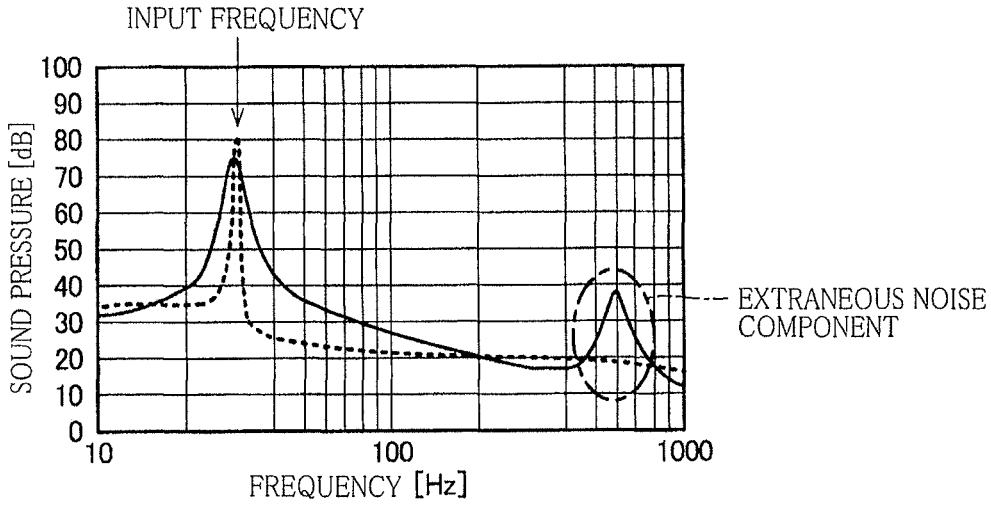
FIG. 5 is a graph for explaining extraneous noise generated from a bass reflex port.

The inner circumferential surface 42 of the end portion 34 employs the shape described above for the purpose of reducing extraneous noise generated from the bass reflex port 30A. There will be explained in detail extraneous noise generated from a bass reflex port. FIG. 5 is a graph showing a relationship between frequency characteristics (indicated by the broken line) of acoustic signal and frequency characteristics (indicated by the solid line) of reproduced sound in an instance where an acoustic signal of pure sound (e.g., a sine wave of 30 Hz) having a frequency equivalent to the Helmholtz resonance frequency is supplied to an existing speaker device. Where a flow rate of the air that flows in the inside of the bass reflex port is high when the frequency close to the Helmholtz resonance frequency is reproduced, the air flow is disturbed in the inside of the bass reflex port and in the vicinity of the distal portion, so that vortex rings are generated. The vortex rings contain wide range of frequency components whose major component is the Helmholtz resonance frequency. A part of the frequency components contained in the vortex rings that coincides with or is close to the resonance frequencies of the bass reflex port and the housing (a part encircled with the dashed line in FIG. 5) is intensified by resonance, so that the part in question is perceived by a listener as extraneous noise.

Figure 6A:
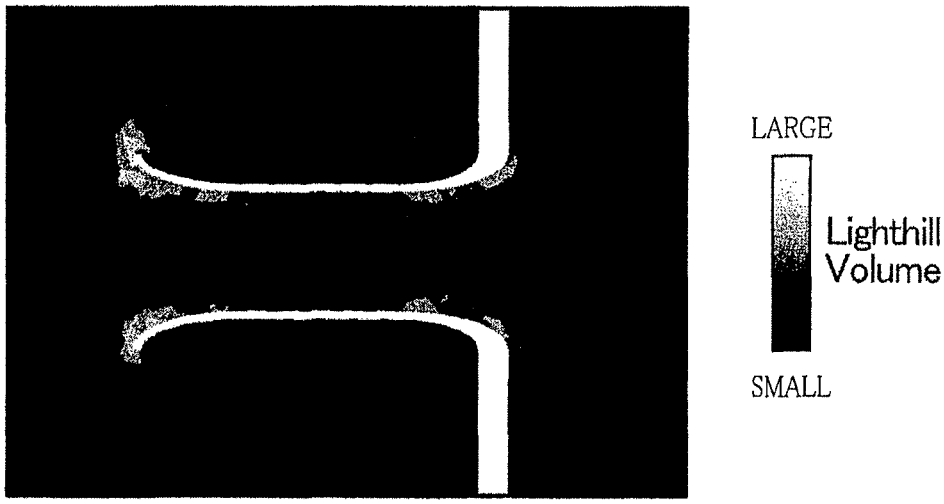
FIG.6A RELATED ART
FIGS. 6A and 6B are distribution views of Lighthill Volume in an inside of and around each of existing ports.
Figure 6B:
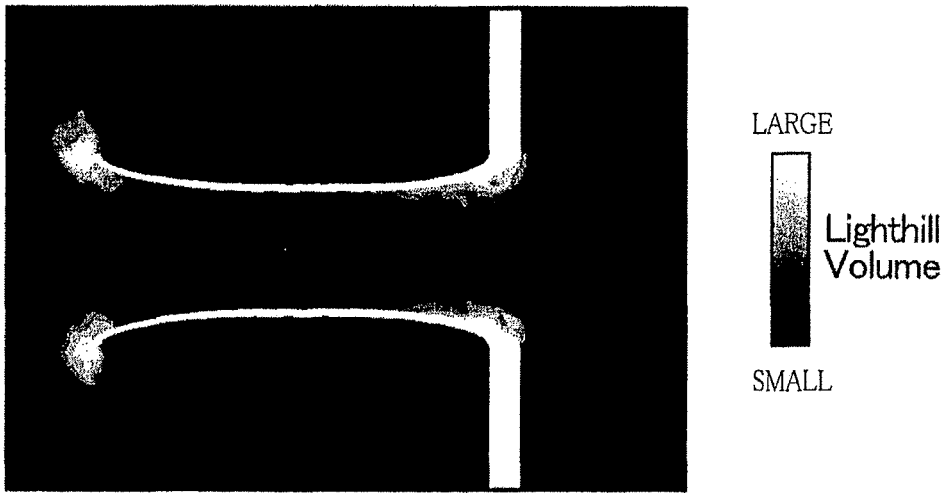
FIG.6B RELATED ART

In view of the above phenomenon, the inventors of the present invention have speculated that the cause of extraneous noise is the vortex rings (the air turbulence) of the air flow that flows in the bass reflex port and have simulated the air turbulence in an inside of each of existing bass reflex ports I and II. In each existing bass reflex port (hereinafter referred to as "existing port"), the inner circumferential region has a circular shape over its entire section in the extension direction of the center axis X. FIG. 6A shows a simulation result of the existing port I and FIG. 6B is a simulation result of the existing port II. Each of the existing ports I and II is a bass reflex port having a flare shape in opposite ends thereof. More specifically, the existing port I is a sample that employs, as the inner circumferential surface in the vertical cross section, an arc of an ellipse having a major axis of 144 mm and a minor axis of 48 mm. The existing port II is a sample that employs, as the inner circumferential surface in the vertical cross section, an arc of an ellipse having a major axis of 230 mm and a minor axis of 48 mm. That is, the ellipticity (the ratio of the minor axis with respect to the major axis) of the inner circumferential surface in the existing port I is greater than the ellipticity of the inner circumferential surface in the existing port II. To speaker devices that respectively employ the existing port I and the existing port II, there were supplied acoustic signals in a frequency equivalent to the Helmholtz resonance frequency. It was observed that extraneous noise perceived from reproduced sound is noticeable in the existing port II, as compared with the existing port I.

In each of FIGS. 6A and 6B, there is illustrated distribution of Lighthill Volume in the inside and in the vicinity of the distal portion of the existing port I, II. The Lighthill Volume is an index for evaluating a degree of a disturbance of an air flow (air turbulence). In each of FIGS. 6A and 6B, a higher Lighthill Volume region (i.e., a region in which the degree of air turbulence is higher) is represented in a higher gray scale level (i.e., a gray scale level closer to a gray scale level of white). From comparison between FIG. 6A and FIG. 6B, the following tendency is confirmed. That is, in the existing port II (FIG. 6B) in which extraneous noise is large, the region in which air turbulence is large exists locally in a narrow range in the vicinity of the distal portion. In contrast, in the existing port I (FIG. 6A) in which extraneous noise is small, the region in which air turbulence is large is distributed in a wide range along the distal portion. The inventors speculated on the basis of the above tendency that extraneous noise generated from the bass reflex port can be suppressed if the region in which large air turbulence occurs (hereinafter referred to as "large air turbulence region" where appropriate) can be distributed in a wide range along the center axis X of the bass reflex port. The bass reflex port 30A of the first embodiment which has been explained with reference to FIGS. 1-4 is a preferred example of the shape employed in view of the findings above.

FIG. 7A is an explanatory view of the large air turbulence region in the existing port in which the inner circumferential surface has a circular flare shape. FIG. 7B is an explanatory view of the large air turbulence region in the bass reflex port 30A of the first embodiment. As apparent from FIG. 7A, in the existing port in which the circular shape of the inner circumferential region is maintained over its entire section, the large air turbulence region occurs over the entire circumference of the inner circumferential surface 42 within a narrow range in the extension direction of the center axis X. In other words, there are generated perfect circular vortex rings in the existing port. In contrast, in the bass reflex port 30A of the first embodiment, the inner circumferential surface 42 (e.g. the locus RA and the locus RB) in the vertical cross section differs in shape at respective positions in the circumferential direction. Accordingly, the vortex rings generated in the bass reflex port 30A have a snaking or winding shape along the circumferential direction. In other words, the large air turbulence region is distributed in a wide range in the extension direction of the center axis X. Thus, the large air turbulence region is distributed in the extension direction of the center axis X, so that extraneous noise that arises from the bass reflex port 30A can be reduced in the first embodiment.

Figure 9:
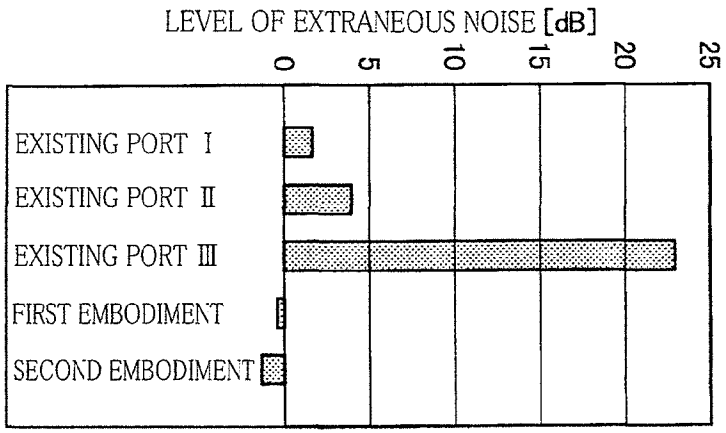
FIG. 9 is a graph showing a level of extraneous noise in each bass reflex port.

FIG. 8 is a graph showing frequency characteristics of reproduced sound in each of a plurality of bass reflex ports having mutually different shapes. FIG. 9 is a graph in which a sound pressure in a frequency band B in FIG. 8 that is perceived by a listener as extraneous noise, namely, an extraneous noise level, is indicated for each of the plurality of bass reflex ports. An existing port III in FIGS. 8 and 9 is a bass reflex port of a straight tube type not having the flare shape. It is confirmed from FIG. 9 that extraneous noise is effectively suppressed in the bass reflex port 30A of the first embodiment in which the inner circumferential surface 42 (e.g., the locus R) in the vertical cross section differs in shape at respective positions in the circumferential direction, as compared with the existing ports as comparative examples. Further, the bass reflex port 30A of the first embodiment whose inner circumferential region Q has the noncircular shape having the rotational symmetry offers a more excellent aesthetic design, as compared with the existing port whose inner circumferential region has a simple perfect circular shape.

Second Embodiment

There will be hereinafter explained a second embodiment of the invention. In the second embodiment, the same reference numerals as used in the first embodiment are used to identify components similar in function and action to those in the first embodiment, and a detailed explanation of the components are dispensed with in the second embodiment.

Figure 10:
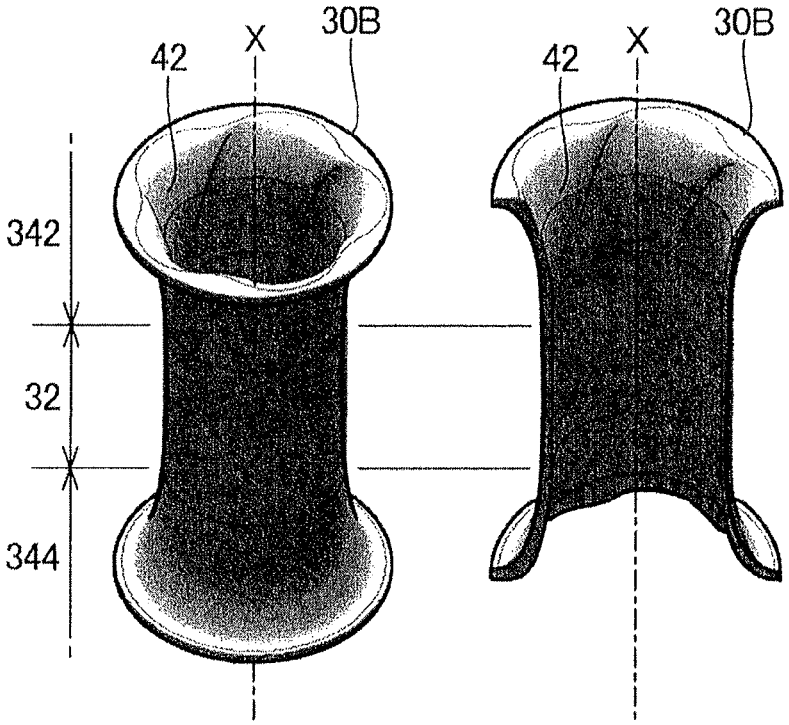
FIG. 10 is a perspective view and a cut view of a bass reflex port according to a second embodiment.
Figure 11:
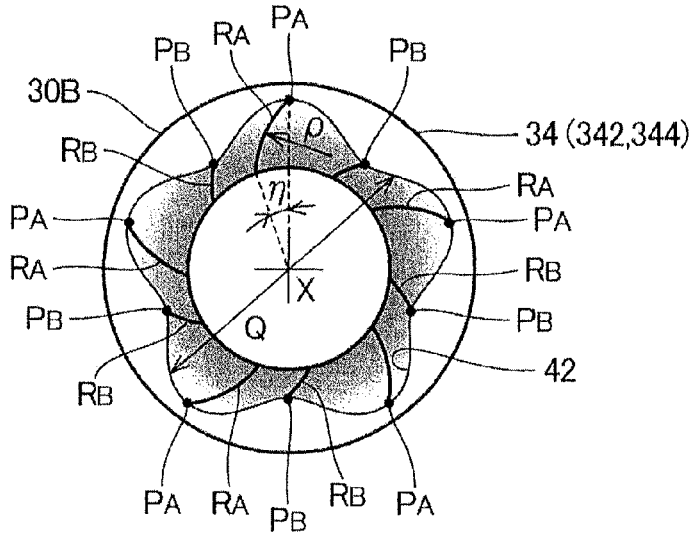
FIG. 11 is a front view of the bass reflex port according to the second embodiment.

FIG. 10 is a perspective view and a cut view on the vertical cross section each showing a bass reflex port 30B according to the second embodiment. FIG. 11 is a front view of the bass reflex port 30B when the distal portion of the end portion 34 (342, 344) is viewed from the extension direction of the center axis X. As apparent from FIGS. 10 and 11, the bass reflex port 30B of the second embodiment is formed to have a shape in which the inner circumferential region Q similar to that in the first embodiment is rotated in accordance with a position in the extension direction of the center axis X, namely, a shape in which the inner circumferential surface 42 is twisted about the center axis X. In other words, each crest portion and each trough portion on the inner circumferential surface 42 of the bass reflex port 30B helically extends along the center axis X.

Figure 12:
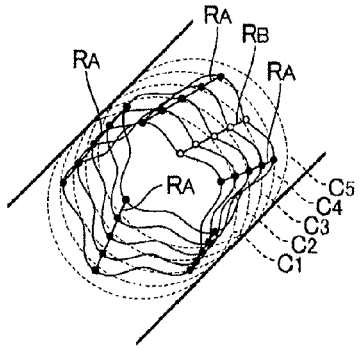
FIG. 12 is a view for explaining a shape of an inner circumferential region.
Figure 13:
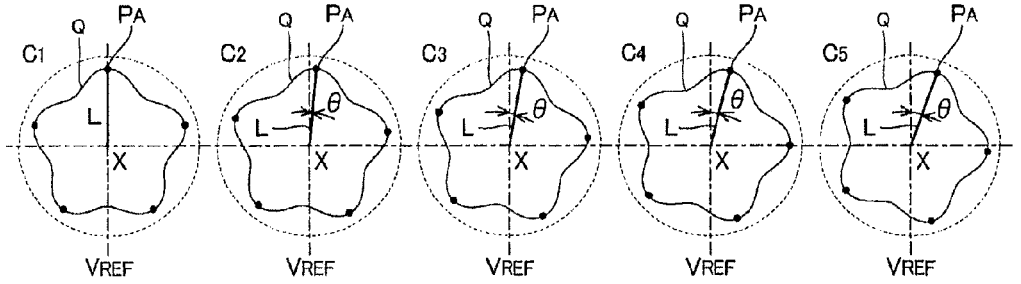
FIG. 13 is a view for explaining the inner circumferential region in each transverse cross section.

FIG. 12 is a schematic view showing a plurality of transverse cross sections C (C1-C5) which differ from one another in position in the extension direction of the center axis X. FIG. 13 is a schematic view showing the inner circumferential regions Q of the respective transverse cross section C in FIG. 12. The transverse cross sections C1-C5 in FIG. 12 are arranged in order from the distal portion of the end portion 34 (one end of the end portion 34 that is remote from the intermediate portion 32) toward the proximal portion. For instance, the transverse cross section C1 is located on the distal portion side of the end portion 34, and the transverse cross section C5 is located on the proximal portion side thereof. The shape of the inner circumferential region Q in one arbitrary transverse cross section C is similar to the shape of the inner circumferential region Q in the first embodiment. That is, the inner circumferential region Q of the end portion 34 has a noncircular shape having rotational symmetry in which the inner radius Φ changes along the circumferential direction about the center axis X. Accordingly, the second embodiment also ensures the advantages similar to those in the first embodiment. As in the first embodiment, the area of the inner circumferential region Q of the end portion 34 (the inner radius Φ) increases in a direction from the proximal portion to the distal portion, namely, the inner circumferential region Q has the flare shape. However, the change in area of the inner circumferential region Q is not illustrated in FIGS. 12 and 13 for the sake of convenience.

As shown in FIG. 13, there is assumed a straight line L that passes one arbitrary maximum point PA on the inner circumferential surface 42 in the transverse cross section C perpendicular to the center axis X and that is orthogonal to the center axis X. (This straight line is hereinafter referred to as "inner radial line" where appropriate.) That is, the inner radial line L is a straight line extending from the center axis X in the radial direction and passing the maximum point PA. As shown in FIG. 13, where there is assumed a specific vertical cross section (hereinafter referred to as "reference plane") VREF that includes the center axis X, an angle θ of the inner radial line L with respect to the reference plane VREF continuously changes in accordance with the position of the transverse cross section C in the extension direction of the center axis X. More specifically, the inner radial line L continuously rotates in one direction with respect to a displacement, in one direction, of the transverse cross section C in the extension direction of the center axis X, e.g., a displacement of the transverse cross section C in the direction from the distal portion to the proximal portion. In other words, as shown in FIG. 13, the angle θ of the inner radial line L in the transverse cross section C2 is larger than the angle θ of the inner radial line L in the transverse cross section C1, and the angle θ of the inner radial line L in the transverse cross section C3 is larger than the angle θ of the inner radial line L in the transverse cross section C2, for instance. Accordingly, as apparent from FIG. 12, a locus RA that connects mutually corresponding maximum points PA (indicated by black dots in FIG. 12) in the plurality of transverse cross sections C1-C5 extends along the center axis X so as to be helical about the center axis X. Similarly a locus RB that connects mutually corresponding minimum points PB (indicated by white dots in FIG. 12) in the plurality of transverse cross sections C1-C5 extends along the center axis X so as to be helical about the center axis X. In other words, as explained above, each of the trough portions (the locus RA of the maximum point PA) and each of the crest portions (the locus RB of the minimum point PB) on the inner circumferential surface 42 extend helically about the center axis X along the center axis X. Further, in the second embodiment, the inner circumferential surface 42 of the end portion 34 has the flare shape and the inner circumferential region Q has the noncircular shape having the rotational symmetry, as in the first embodiment. Therefore, the locus RA of the maximum point PA and the locus RB of the minimum point PB differ from each other in shape (e.g., the curvature and the entire length). More specifically, the entire length of the locus RA is greater than the entire length of the locus RB.

As shown in FIG. 11, the inner radial line L rotates by an angle η from the proximal portion to the distal portion of the end portion 34, namely, over an entire range of the end portion 34 between its opposite ends. The angle η is set to an arbitrary suitable value. However, where the angle η is large, it is difficult to remove a metal mold from the bass reflex port when the bass reflex port is formed by injection molding. In view of this, the angle η is preferably held in a range lower than an angle (e.g., 20°) that ensures reliable removal of the mold for injection molding. For instance, the angle η set at 18° (360°/4N) is preferable. On the other hand, where the angle η is excessively large, a disturbance of the air flow (air turbulence) is likely to occur in the vicinity of the inner circumferential surface 42. Accordingly, the angle η is suitably selected from a range set such that generation of extraneous noise that arises from air turbulence is not perceived, for instance. To be more specific, an upper limit value of the angle η is suitably determined considering various factors that influence air turbulence (such as a flow rate expected for the air in the bass reflex port 30B).

Further, a rotation angle (hereinafter referred to as "unit angle" where appropriate) of the inner radial line L when the transverse cross section C is displaced along the center axis X by a unit amount differs depending upon a position of the transverse cross section C in the extension direction of the center axis X. To be more specific, in the end portion 34, the value of the unit angle is larger on a distal-end side of the bass reflex port 30B (remote from the intermediate portion 32) than an intermediate side of the bass reflex port 30B (near to the intermediate portion 32). In other words, the value of the unit angle increases toward the distal portion of the end portion 34. Accordingly, as shown in FIG. 11, the locus RA (i.e., a projection image of the locus RA on a projection plane perpendicular to the center axis X) when the distal portion of the end portion 34 is viewed from the extension direction of the center axis X, namely, viewed from the front side of the bass reflex port 30B, is a curved line having a curvature ρ. The curvature ρ is set to a value equal to about 1/50 [1/mm] (the radius of curvature: 50 mm).

As explained above in the first embodiment referring to FIG. 7, in the existing port having the circular inner circumferential region Q, extraneous noise is noticeably perceived due to generation of perfect circular vortex rings in the inside of the existing port. In contrast, in the first embodiment, the vortex rings generated in the inside of the bass reflex port 30A are wound or snaked in the circumferential direction, namely, the large air turbulence region is distributed in a wide range in the extension direction of the center axis X, so that extraneous noise is reduced. As speculated from the tendency described above, extraneous noise is reduced with a decrease in geometric symmetry of the vortex rings about the center axis X. In the second embodiment, the shape of the inner circumferential surface 42 of the end portion 34 is determined such that the trough portions (the locus RA of the maximum point PA) and the crest portions (the locus RB of the minimum point PB) on the inner circumferential surface 42 are helical. Accordingly, the geometric symmetry of the vortex rings in the bass reflex port 30B is lowered, as compared even with the first embodiment as well as the existing port. According to the second embodiment, therefore, extraneous noise can be further reduced, as compared with the first embodiment. In the graphs of FIGS. 8 and 9, there is also indicated the extraneous noise level observed in the bass reflex port 30B according to the second embodiment. It is confirmed from FIGS. 8 and 9 that the effect of reduction of extraneous noise in the second embodiment is higher than that in the first embodiment. Further, the bass reflex port 30B according to the second embodiment in which the crest portions and the trough portions on the inner circumferential surface 42 are helical offers a more excellent aesthetic design, as compared with the existing port whose inner circumferential region has a simple perfect circular shape and the bass reflex port 30A according to the first embodiment in which the inner radial line L does not rotate.

<Concrete Configuration of Bass Reflex Port>

There will be hereinafter illustrated preferable configurations of the bass reflex port 30 (30A, 30B) from various aspects on the basis of the explanations of the first embodiment and the second embodiment. In the following explanation, the structure of the first embodiment in which the inner circumferential region Q has the noncircular shape having the rotational symmetry (the structure in which the inner radius Φ changes in the circumferential direction) is referred to as "feature A" for the sake of convenience. Similarly, the structure of the second embodiment in which the angle θ of the inner radial line L is changed in accordance with the position of the transverse cross section C in the extension direction of the center axis X (the structure in which the trough portions and the crest portions on the inner circumferential surface 42 are helical) is referred to as "feature B" for the sake of convenience.

<Aspect 1>

In the first embodiment, the feature A and the feature B are employed in both of the end portion 342 and the end portion 344 of the bass reflex port 30. The feature A and the feature B may be employed in only one of the end portion 342 and the end portion 344.

Figure 14:
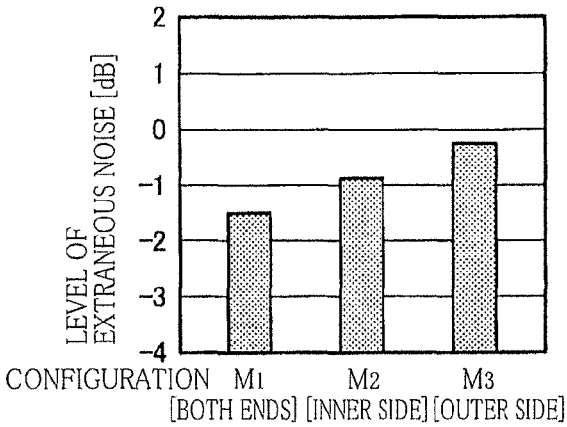
FIG. 14 is a graph showing a relationship between shape of bass reflex port and level of extraneous noise.

FIG. 14 shows measurement results of the extraneous noise level for a plurality of samples which differ from one another as to whether the feature A and the feature B are employed in both of the end portion 342 and the end portion 344 or in one of the end portion 342 and the end portion 344. In a configuration M1 of FIG. 14, the feature A and the feature B are employed in both of the end portion 342 and the end portion 344 (the second embodiment). In a configuration M2, the feature A and the feature B are employed only in the end portion 344 on the rear side. In a configuration M3, the feature A and the feature B are employed only in the end portion 342 on the front side. In each of the end portion 342 of the configuration M2 and the end portion 344 of the configuration M3, the inner circumferential region has the perfect circular flare shape, as in the existing port I and the existing port II.

As is understood from FIG. 14, the effect of suppressing extraneous noise is larger in the configuration M1 in which the feature A and the feature B are employed in both of the end portion 342 and the end portion 344 than in the configurations (M2, M3) in which the feature A and the feature B are employed in only one of the end portion 342 and the end portion 344. Accordingly, as illustrated in the first embodiment and the second embodiment, the configuration in which the feature A and the feature B are employed in both of the end portion 342 and the end portion 344 is preferable from the viewpoint of maximizing the effect of reducing extraneous noise.

In the meantime, it is actually expected that the production cost of the end portion 34 that employs the feature A and the feature B exceeds the production cost of the end portion 34 having a simple shape without employing the feature A and the feature B. In terms of reduction of the production cost, therefore, it is advantageous to employ the feature A and the feature B in only one of the end portion 342 and the end portion 344. From FIG. 14, a tendency is observed that the configuration M2 in which the feature A and the feature B are employed in the end portion 344 on the rear side exhibits a larger effect of suppressing extraneous noise than in the configuration M3 in which the feature A and the feature B are employed in the end portion 342 on the front side. Accordingly, from the viewpoint of effectuating both of suppression of extraneous noise and reduction of the production cost, the configuration M2 in which the feature A and the feature B are employed in the end portion 344 on the rear side is more preferable than the configuration M3 in which the feature A and the feature B are employed in the end portion 342 on the front side. In the meantime, the end portion 344 disposed in the inside of the housing 10 is unlikely to be visually recognized from the outside. Therefore, from the viewpoint of giving a higher priority to the aesthetic design of the feature A and the feature B, the configuration M3 is preferable in which the feature A and the feature B are employed in the end portion 342 that is likely to be visually recognized from the outside.

<Aspect 2>

Figure 15:
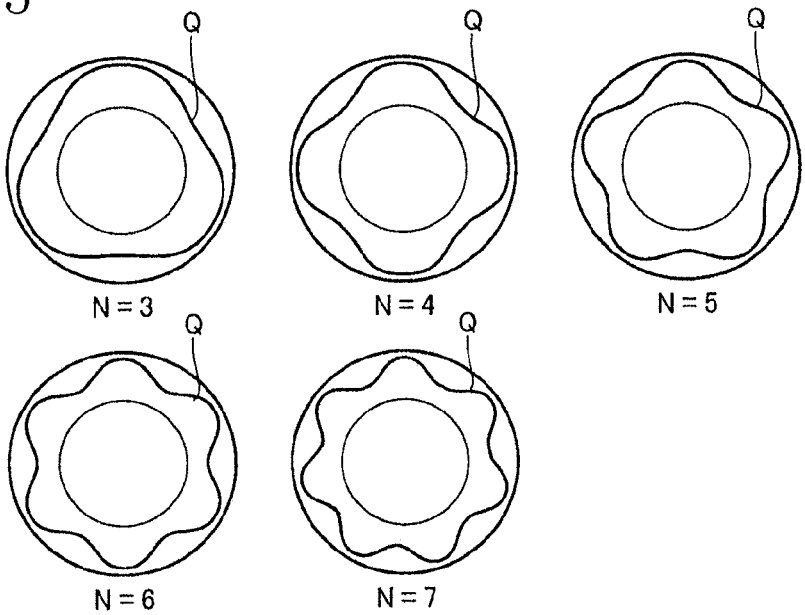
FIG. 15 is a schematic view showing otherwise-shaped inner circumferential regions.

In the embodiments illustrated above, the inner circumferential region Q has the noncircular shape having five-fold rotational symmetry. The order N of the rotational symmetry may be a value other than 5, as shown in FIG. 15. In FIG. 15, there are illustrated the inner circumferential regions Q having three-fold rotational symmetry (N=3) through seven-fold rotational symmetry (N=7).

Figure 16:
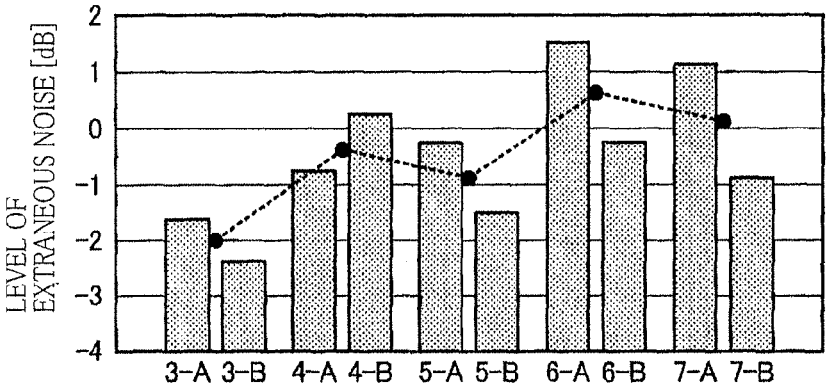
FIG. 16 is a graph showing a relationship between order of rotational symmetry of inner circumferential region and level of extraneous noise.

FIG. 16 is a graph showing measurement results of the extraneous noise level for a plurality of configurations having different orders N of the rotational symmetry. The symbol N-A (N=3–7) in FIG. 16 indicates that the inner circumferential region Q has the noncircular shape having the rotational symmetry and the feature B is not employed while the symbol N-B indicates that the inner circumferential region Q has the noncircular shape having the rotational symmetry and the feature B is employed. Further, in FIG. 16, an average value of the extraneous noise level in the configuration employing the feature B and the extraneous noise level in the configuration not employing the feature B is also indicated by a black dot for each order N.

A general tendency is confirmed from FIG. 16 that the effect of suppressing extraneous noise becomes larger with a decrease in the order N of the rotational symmetry. Accordingly, the configuration in which the order N of the rotational symmetry is set at a smaller value (e.g., N=3–5) is preferable. Further, a tendency is confirmed from FIG. 16 that the effect of suppressing extraneous noise is larger in an instance in which the order N of the rotational symmetry is an odd number, as compared with an instance in which the order N of the rotational symmetry is an even number. Accordingly, the configuration in which the order N of the rotational symmetry is set at an odd number is preferable. In this respect, the tendency that the effect of suppressing extraneous noise is larger when the order N of the rotational symmetry is an odd number (i.e., when geometric symmetry of the inner circumferential region Q is low) than when the order N is an even number matches the above-indicated tendency that extraneous noise is reduced with a decrease in the geometric symmetry of the vortex rings generated in the bass reflex port 30.

Considering comprehensively the tendencies described above, the configuration in which the order N of the rotational symmetry is a small odd number (e.g., N=3, 5) is particularly preferable in terms of reduction of extraneous noise. In the present invention, however, the order N of the rotational symmetry of the inner circumferential region Q is arbitrary.

<Aspect 3>

Figure 17A:
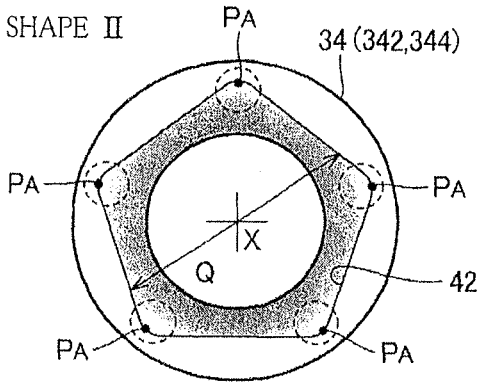
FIGS. 17A and 17B are schematic views showing otherwise-shaped inner circumferential regions.

In the embodiments illustrated above, the profile line of the inner circumferential region Q is curved over the entire circumference. The profile line of the inner circumferential region Q may include a straight line(s). For instance, as shown in FIG. 17A, it is possible to employ the inner circumferential region Q having a shape (hereinafter referred to as "shape II") in which angular portions of a polygon (a pentagon in FIG. 17) having the rotational symmetry are formed in arcs. The shape II may be expressed as a shape in which there exist no minimum points PB having the inner radius Φ, namely, there exist no crest portions on the inner circumferential surface 42.

Figure 18:
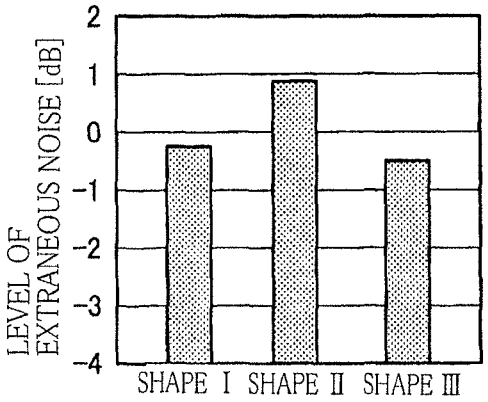
FIG. 18 is a graph showing a relationship between shapes illustrated in FIG. 17 and level of extraneous noise.

FIG. 18 is a graph showing measurement results of the extraneous noise level for a configuration in which the inner circumferential region Q has a shape (hereinafter referred to as "shape I") defined by a closed curve and having the rotational symmetry, as in the first embodiment (FIG. 3 or FIG. 11) and a configuration in which the inner circumferential region Q has the shape II shown in FIG. 17A. In FIG. 18, the feature B is omitted for the sake of convenience. A tendency is observed from FIG. 18 that the extraneous noise level is higher in the configuration in which the inner circumferential region Q has the shape II than in the configuration in which the inner circumferential region Q has the shape I. Accordingly, in terms of reduction of extraneous noise, the configuration in which the inner circumferential region Q has the shape I defined by the closed curve as in the first embodiment is advantageous, as compared with the configuration in which the inner circumferential region Q has the shape II including straight lines.

As explained above with reference to FIGS. 6A and 6B, the extraneous noise level in the existing port II having smaller ellipticity of the ellipse exceeds the extraneous noise level in the existing port I having larger ellipticity of the ellipse, the ellipticity defining the inner circumferential surface. In other words, there is a tendency that extraneous noise is reduced more effectively with an increase in the ellipticity of the ellipse that defines the inner circumferential surface 42. In the shape II shown in FIG. 17A, a range having large ellipticity in the inner circumferential surface 42 i.e., a range (indicated by each portion enclosed with the dashed-line in FIG. 17) that is similar in shape to the locus RA of the maximum point PA, is narrower than in the first embodiment. Accordingly, it is speculated that the extraneous noise level is high in the configuration in which the inner circumferential region Q has the shape II because the range having larger ellipticity in the inner circumferential surface 42 is narrow.

Figure 17B:
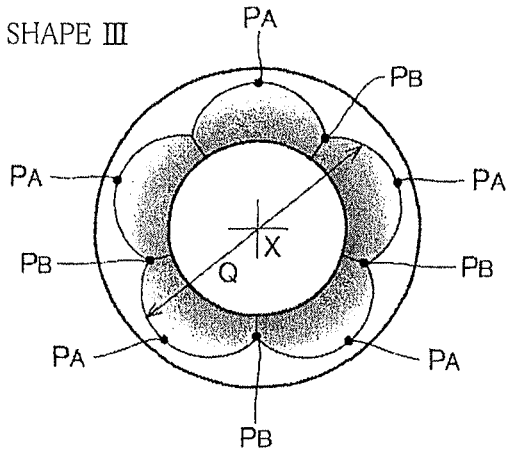

In view of the above, a shape III shown in FIG. 17B that sufficiently ensures the range having larger ellipticity in the inner circumferential surface 42 is preferable as the shape of the inner circumferential region Q. FIG. 18 also indicates the level of extraneous noise perceived in a configuration that employs the shape III. As is understood from FIG. 18, the shape III enables the effect of suppressing extraneous noise to be intensified to a higher degree, as even compared with the shape II as well as the shape I. The results match the tendency described above that extraneous noise is reduced more effectively with an increase in the ellipticity of the ellipse that defines the inner circumferential surface 42. In the above explanation, the configuration in which the feature B is omitted is assumed for the sake of convenience. It is needless to mention that the feature B can be also employed regardless of the shape of the inner circumferential region Q.

<Modifications>

The illustrated embodiments may be variously modified. There will be hereinafter concretely described modified arrangements. It is noted that arbitrarily selected at least two of the following modified arrangements may be suitably combined.

(1) In the illustrated embodiments, the feature A and the feature B are applied to the entire section (between the opposite ends) of the end portion 34. The feature A and the feature B may be applied only to a specific section (e.g., a section on the distal portion side) of the end portion 34. Further, in the illustrated embodiments, the intermediate portion 32 is interposed between the end portion 342 and the end portion 344. The intermediate portion 32 may be omitted. Accordingly, the feature A and the feature B may be applied to the entire section of the bass reflex port 30.

(2) In the second embodiment, the bass reflex port 30B having both of the feature A and the feature B is illustrated. The feature A is not an essential requirement for the feature B, and the feature A may be omitted in the second embodiment. That is, the inner circumferential region Q may have any arbitrary shape in the feature B (the second embodiment) in which the crest portions and the trough portions on the inner circumferential surface 42 are formed so as to extend helically. However, rotation of the inner radial line L in accordance with the position of the transverse cross section C in the extension direction of the center axis X cannot be conceived in an instance where the inner circumferential region Q has a perfect circular shape. In such an instance, therefore, the shape of the inner circumferential region Q in the feature B is naturally noncircular.

(3) In the illustrated embodiments, the inner radial line L rotates in one direction with respect to the displacement of the transverse cross section C in the extension direction of the center axis X, in other words, the angle θ of the inner radial line L monotonously increases or decreases with respect to the displacement of the transverse cross section C. The direction of rotation of the inner radial line L with respect to the displacement of the transverse cross section C is not limited to that illustrated above. For instance, the rotation direction of the inner radial line L may be reversed at a position located midway in the end portion 34. Further, continuity of the change of the angle θ of the inner radial line L is not an essential requirement. That is, the angle θ may discontinuously change with respect to the displacement of the transverse cross section C. As is understood from the above explanation, a preferred embodiment of the present invention may be comprehensively expressed as a structure in which the angle θ of the inner radial line L in a transverse cross section (first transverse cross section) CA located in the extension direction of the center axis X differs from the angle θ of the inner radial line L in a transverse cross section (second transverse cross section) CB that differs from the transverse cross section CA in position in the extension direction of the center axis X.

(4) In the illustrated embodiments, the bass reflex port 30 employed in the speaker device 100 is exemplified. The characteristics of the bass reflex port 30 in each embodiment are applicable to tubular bodies other than the bass reflex port 30. Examples of the tubular bodies to which the present invention is applicable include mufflers of two-wheeled vehicles and four-wheeled vehicles, intake/exhaust ducts of air conditioning systems, and so on. The present invention is also applicable to tubular bodies of musical instruments, typically, wind instruments, such as brass instruments and woodwind instruments.

What is claimed is:

1. A bass reflex port which has a tubular shape and through which air flows, wherein an angle of a first inner radial line with respect to a reference plane that includes a center axis of the bass reflex port differs from an angle of a second inner radial line with respect to the reference plane, the first inner radial line being orthogonal to the center axis and passing through a first characteristic point located on an inner circumference of the bass reflex port in a first transverse cross section perpendicular to the center axis, the second inner radial line being orthogonal to the center axis and passing through a second characteristic point corresponding to the first characteristic point and located on the inner circumference in a second transverse cross section perpendicular to the center axis, the first transverse cross section and the second transverse cross section differing from each other in position in a direction of extension of the center axis.

2. The bass reflex port according to claim 1, wherein an angle of an inner radial line with respect to the reference plane continuously changes with respect to a displacement, in the direction of extension of the center axis, of a transverse cross section perpendicular to the center axis, the inner radial line being orthogonal to the center axis and passing through a characteristic point as each of the first characteristic point and the second characteristic point located on the inner circumference in the transverse cross section, and wherein a rotation angle of the inner radial line with respect to the displacement of the transverse cross section in the direction of extension of the center axis by a unit amount differs depending upon a position of the transverse cross section in the direction of extension of the center axis.

3. A bass reflex port which has a tubular shape and through which air flows, wherein a locus that connects characteristic points each located on an inner circumference of the bass reflex port in a corresponding one of a plurality of transverse cross sections is helical, the transverse cross sections being perpendicular to a center axis of the bass reflex port and differing from each other in position in a direction of extension of the center axis.

4. The bass reflex port according to claim 1, wherein a first locus and a second locus differ from each other in shape, the first locus connecting characteristic points each located on the inner circumference in a corresponding one of a plurality of transverse cross sections perpendicular to the center axis, the second locus connecting characteristic points each of which is located on the inner circumference in a corresponding one of the transverse cross sections and which differ from the characteristic points of the first locus.

5. The bass reflex port according to claim 1, wherein an inner circumferential region enclosed by an inner circumferential surface of the bass reflex port in a transverse cross section perpendicular to the center axis has a noncircular shape having rotational symmetry.

6. The bass reflex port according to claim 5, wherein an order of the rotational symmetry of the inner circumferential region is an odd number.

7. The bass reflex port according to claim 5, wherein an order of the rotational symmetry of the inner circumferential region is 3 or 5.

8. A bass reflex port which has a tubular shape and through which air flows, wherein a trough portion and a crest portion are repeatedly formed, along a circumferential direction of the bass reflex port, on an intersection line between an inner circumferential surface of the bass reflex port along a circumferential direction of the bass reflex port and a transverse cross section perpendicular to a center axis of the bass reflex port, a distance between the trough portion and the center axis in a direction perpendicular to the center axis being larger than a distance between the crest portion and the center axis in the direction perpendicular to the center axis.

9. The bass reflex port according to claim 8, wherein an inner circumferential region enclosed by the inner circumferential surface of the bass reflex port in the transverse cross section has a noncircular shape having rotational symmetry.

10. The bass reflex port according to claim 9, wherein an order of the rotational symmetry of the inner circumferential region is an odd number.

11. The bass reflex port according to claim 9, wherein an order of the rotational symmetry of the inner circumferential region is 3 or 5.

12. The bass reflex port according to claim 8, comprising an intermediate portion and two end portions located on one and the other of opposite sides of the intermediate portion in a direction of extension of the center axis, wherein the crest portion and the trough portion are formed in each of the two end portions and are not formed in the intermediate portion.

13. The bass reflex port according to claim 1, wherein the first characteristic point is located on a first line that is an intersection line between the inner circumference of the bass reflex port and the first transverse cross section, wherein the second characteristic point is located on a second line that is a line of intersection between the inner circumference of the bass reflex port and the second transverse cross section, and wherein the first characteristic point is a maximum point at which an inner radius is maximum on the first line and the second characteristic point is a maximum point at which an inner radius is maximum on the second line.

14. The bass reflex port according to claim 13, wherein an angle of a third inner radial line with respect to the reference plane differs from an angle of a fourth radial line with respect to the reference plane, the third inner radial line being orthogonal to the center axis and passing through a third characteristic point located on the first line, the fourth inner radial line being orthogonal to the center axis and passing through a fourth characteristic point corresponding to the third characteristic point and located on the second line, and wherein the third characteristic point is a minimum point at which an inner radius is minimum on the first line, and the fourth characteristic point is a minimum point at which an inner radius is minimum on the second line.

15. The bass reflex port according to claim 14, wherein a plurality of maximum points each as the first characteristic point located on the first line and a plurality of minimum points each as the third characteristic point and located on the first line are alternate with each other along the first line, and wherein a plurality of maximum points each as the second characteristic point located on the second line and a plurality of minimum points each as the fourth characteristic point located on the second line are alternate with each other along the second line.

16. The bass reflex port according to claim 1, wherein an angle of a third inner radial line with respect to the reference plane differs from an angle of a fourth radial line with respect to the reference plane, the third inner radial line being orthogonal to the center axis and passing through a third characteristic point located on a first line, the fourth inner radial line being orthogonal to the center axis and passing through a fourth characteristic point corresponding to the third characteristic point and located on a second line, wherein the third characteristic point is located on the first line that is an intersection line between the inner circumference of the bass reflex port and the first transverse cross section, wherein the fourth characteristic point is located on the second line that is an intersection line between the inner circumference of the bass reflex port and the second transverse cross section, and wherein the third characteristic point is a minimum point at which an inner radius is minimum on the first line, and the fourth characteristic point is a minimum point at which an inner radius is minimum on the second line.

* * * * *